US009242768B2

(12) United States Patent
Skelton et al.

(10) Patent No.: US 9,242,768 B2
(45) **Date of Patent: *Jan. 26, 2016**

(54) TAMPER EVIDENT CLOSURE

(71) Applicant: OBRIST CLOSURES SWITZERLAND GMBH, Reinach (CH)

(72) Inventors: Steven Andrew Skelton, Scotland (GB); Christopher Ramsey, Oxfordshire (GB); Charles Anthony McIvor, Scotland (GB); Steven Allan McCluskie, Scotland (GB)

(73) Assignee: OBRIST CLOSURES SWITZERLAND GMBH, Reinach (CH)

( * ) Notice: Subject to any disclaimer, the term of this patent is extended or adjusted under 35 U.S.C. 154(b) by 0 days.

This patent is subject to a terminal disclaimer.

(21) Appl. No.: 13/828,642

(22) Filed: Mar. 14, 2013

(65) Prior Publication Data

US 2013/0206765 A1 Aug. 15, 2013

Related U.S. Application Data

(63) Continuation of application No. 10/577,575, filed as application No. PCT/EP2004/012056 on Oct. 26, 2004, now Pat. No. 8,522,991.

(30) Foreign Application Priority Data

Oct. 31, 2003 (EP) ..... 03257261

(51) Int. Cl.
*B65D 41/62* (2006.01)
*B65D 41/34* (2006.01)

(Continued)

(52) U.S. Cl.
CPC ..... *B65D 41/0478* (2013.01); *B65D 41/0492* (2013.01); *B65D 41/3428* (2013.01); *B65D49/06* (2013.01); *B65D 50/041* (2013.01); *B65D 2251/0015* (2013.01); *B65D 2251/0078* (2013.01)

(58) Field of Classification Search
CPC .... B65D 41/62; B65D 41/34; B65D 41/3423; B65D 41/3442; B65D 2101/0023; B65D 2101/0069; B65D 2101/0084
USPC ..... 215/252; 220/254.1, 254.8, 257.1, 220/259.3, 259.4, 290
See application file for complete search history.

(56) References Cited

U.S. PATENT DOCUMENTS

| | | | |
|---|---|---|---|
| 1,798,151 | A | 3/1931 | Fabrice |
| 2,858,054 | A | 10/1958 | Harkrader |

(Continued)

FOREIGN PATENT DOCUMENTS

| | | |
|---|---|---|
| DE | 809896 | 8/1951 |
| DE | 861666 | 1/1953 |
| DE | 8535205 | 2/1986 |
| DE | 3605963 | 8/1987 |
| DE | 20019797 | 5/2001 |
| EP | 0127943 | 12/1984 |

(Continued)

OTHER PUBLICATIONS

Serial No. PCT/EP2005/053441, completed Dec. 1, 2005, International Search Report and Written Opinion of the International Searching Authority, 5 pages.
Serial No. PCT/EP2003/07798, mailed Oct. 15, 2004, International Search Report and Written Opinion of the International Searching Authority, 5 pages.

(Continued)

*Primary Examiner* — Fenn Mathew
*Assistant Examiner* — Andrew T Kirsch
(74) *Attorney, Agent, or Firm* — Bradley Arant Boult Cummings LLP

(57) ABSTRACT

A tamper-evident closure (10) for a container (20) is provided. The closure (10) comprises a first portion (25) including inner (35) and outer (45) parts, and a second portion (30). The outer part (45) is movable relative to the inner part (35) from a first position in which the outer part (45) is immediately adjacent the second portion (30) to a second position in which there is an empty unobstructed gap (G) therebetween. The inner (35) and outer (45) parts are adapted to become irreversibly locked in the second position so that the outer part (45) cannot be moved back to the first position to close the gap (G). A combination of such a closure (110) with an in-bore filament (100) connectable to a container (120) is also provided.

20 Claims, 13 Drawing Sheets

(51) Int. Cl.

| | |
|---|---|
| ***B65D 51/18*** | (2006.01) |
| ***B65D 51/20*** | (2006.01) |
| ***B65D 43/18*** | (2006.01) |
| ***B65D 41/04*** | (2006.01) |
| ***B65D 39/00*** | (2006.01) |
| ***B65D 41/00*** | (2006.01) |
| ***B65D 43/00*** | (2006.01) |
| ***B65D 47/00*** | (2006.01) |
| ***B65D 51/00*** | (2006.01) |
| ***B65D 49/06*** | (2006.01) |
| ***B65D 50/04*** | (2006.01) |

(56) References Cited

U.S. PATENT DOCUMENTS

| | | | | |
|---|---|---|---|---|
| 3,348,718 | A | 10/1967 | Musy | |
| 3,412,890 | A | 11/1968 | Rich | |
| 3,425,578 | A | 2/1969 | Owens | |
| 3,455,479 | A | 7/1969 | Wilton | |
| 3,603,470 | A | 9/1971 | Armour | |
| 3,810,556 | A | 5/1974 | Coursaut | |
| 3,820,683 | A | 6/1974 | Jasinski | |
| 3,871,545 | A | 3/1975 | Bereziat | |
| 3,892,351 | A | 7/1975 | Johnson | |
| 4,091,949 | A | 5/1978 | Fowles | |
| 4,303,171 | A | 12/1981 | Schremmer | |
| 4,310,105 | A | 1/1982 | Gach | |
| 4,531,649 | A | 7/1985 | Shull | |
| 4,569,464 | A | 2/1986 | Wassilieff | |
| 4,637,519 | A | 1/1987 | Dutt | |
| 4,697,719 | A | 10/1987 | Allen | |
| 4,790,442 | A | 12/1988 | Gach | |
| 4,838,441 | A | 6/1989 | Chernack | |
| 4,941,592 | A | 7/1990 | Kitterman | |
| 4,942,970 | A | 7/1990 | Jay | |
| 5,004,126 | A | 4/1991 | Klesius | |
| 5,332,113 | A | 7/1994 | Kusler | |
| 5,427,260 | A | 6/1995 | Mueller | |
| 5,445,824 | A | 8/1995 | Someya | |
| 5,588,545 | A | 12/1996 | King | |
| 5,603,422 | A | 2/1997 | Herrmann | |
| 5,683,016 | A | 11/1997 | Santagiuliana | |
| 5,755,348 | A | 5/1998 | Luch | |
| 5,819,965 | A | 10/1998 | King | |
| 6,036,036 | A | 3/2000 | Bilani | |
| 6,095,375 | A | 8/2000 | Adams | |
| 6,269,986 | B1 | 8/2001 | Gross | |
| 6,328,174 | B1 * | 12/2001 | Marangoni Graziani et al. | 215/249 |
| 6,484,879 | B2 | 11/2002 | Desmarais | |
| 6,683,038 | B2 | 1/2004 | Forth | |
| 6,685,046 | B2 | 2/2004 | Ogino | |
| 6,688,501 | B2 | 2/2004 | DeGroot | |
| 6,727,215 | B2 | 4/2004 | Roberts | |
| 6,866,164 | B2 | 3/2005 | Branson | |
| 6,880,729 | B2 | 4/2005 | Stull | |
| 7,121,419 | B2 | 10/2006 | Ferry | |
| 7,125,828 | B2 | 10/2006 | Catlin | |
| 7,204,383 | B2 | 4/2007 | Hsu | |
| 8,453,856 | B2 | 6/2013 | Skelton | |
| 8,522,991 | B2 * | 9/2013 | Skelton et al. | 215/252 |
| 2002/0125249 | A1 | 9/2002 | Baird-Smith | |
| 2004/0026420 | A1 | 2/2004 | Smith | |
| 2004/0143505 | A1 | 7/2004 | Kovach | |
| 2005/0133475 | A1 | 6/2005 | Goto | |
| 2005/0205607 | A1 | 9/2005 | Hierzer | |
| 2006/0011573 | A1 | 1/2006 | Herald | |
| 2006/0043052 | A1 | 3/2006 | Lin | |
| 2006/0077062 | A1 | 4/2006 | Andrechak | |
| 2006/0124646 | A1 | 6/2006 | Guglielmini | |
| 2007/0090110 | A1 | 4/2007 | Skelton | |
| 2008/0190880 | A1 | 8/2008 | Needham | |
| 2008/0277613 | A1 | 11/2008 | Ramsey | |
| 2009/0173007 | A1 | 7/2009 | Fogg | |
| 2011/0259844 | A1 | 10/2011 | Skelton | |

FOREIGN PATENT DOCUMENTS

| | | |
|---|---|---|
| EP | 0132792 | 2/1985 |
| EP | 0179498 | 4/1986 |
| EP | 0236136 | 9/1987 |
| EP | 0306670 | 3/1989 |
| EP | 0337568 | 10/1989 |
| EP | 0414462 | 2/1991 |
| EP | 0593952 | 9/1993 |
| EP | 0619243 | 10/1994 |
| EP | 0688723 | 12/1995 |
| EP | 1101707 | 5/2001 |
| EP | 1266839 | 12/2002 |
| EP | 1283175 | 2/2003 |
| EP | 1161382 | 9/2003 |
| EP | 2005053085 | 6/2004 |
| EP | 0425391 | 6/2005 |
| EP | 1694576 | 2/2008 |
| EP | 1786698 | 9/2008 |
| EP | 1663809 | 10/2008 |
| FR | 2439139 | 5/1980 |
| FR | 2567106 | 1/1986 |
| FR | 2591571 | 6/1987 |
| GB | 1298084 | 11/1972 |
| GB | 1473482 | 5/1977 |
| GB | 1484517 | 9/1977 |
| GB | 2123392 | 2/1984 |
| GB | 2136782 | 9/1984 |
| GB | 2148235 | 5/1985 |
| GB | 2158424 | 11/1985 |
| GB | 2172803 | 10/1986 |
| GB | 2222821 | 3/1990 |
| GB | 2264110 | 8/1993 |
| GB | 2311283 | 9/1997 |
| GB | 2355269 | 4/2001 |
| GB | 2356842 | 6/2001 |
| GB | 2375516 | 11/2002 |
| GB | 2430667 | 4/2007 |
| GB | 2415426 | 5/2007 |
| GB | 2432153 | 11/2007 |
| JP | 10 338251 | 3/1999 |
| JP | 2000/229651 | 8/2000 |
| JP | 2003160162 | 11/2001 |
| WO | 9407470 | 4/1994 |
| WO | 9957031 | 11/1999 |
| WO | 0026878 | 5/2000 |
| WO | 0066451 | 11/2000 |
| WO | 0136290 | 5/2001 |
| WO | 0183668 | 11/2001 |
| WO | 0244047 | 6/2002 |
| WO | 02085730 | 10/2002 |
| WO | 02096771 | 12/2002 |
| WO | 03016162 | 2/2003 |
| WO | 03016165 | 2/2003 |
| WO | 2004011347 | 2/2004 |
| WO | 2005024745 | 3/2005 |
| WO | 2005049443 | 6/2005 |
| WO | 2006000532 | 1/2006 |
| WO | 2006003168 | 1/2006 |
| WO | 2006008285 | 1/2006 |
| WO | 2006020059 | 2/2006 |
| WO | 2006117505 | 11/2006 |
| WO | 2007125292 | 11/2007 |
| WO | 2009056829 | 5/2009 |

OTHER PUBLICATIONS

EP 1 663 809 B1 Documents related to EP Opposition (EP Patent Granted)—8 pages.

International Search Report dated Feb. 27, 2008; UK Application No. GB 0721330.9; 4 pages.

* cited by examiner

TAMPER EVIDENT CLOSURE

CROSS-REFERENCE TO RELATED APPLICATIONS

This application is a continuation of U.S. application Ser. No. 11/577,575, filed Sep. 5, 2006, which is currently pending. U.S. application Ser. No. 10/577,575 is a 371 National Stage of International Application No. PCT/EP2004/012056, filed Oct. 26, 2004. International Application No. PCT/EP2004/012056 cites for priority European Patent Application No. 03257261.2, filed Oct. 31, 2003, which is currently pending.

BACKGROUND OF THE DISCLOSURE

The present invention relates generally to a closure for a container and particularly to a closure with means for indicating that the closure has been opened at least once.

There is an increasing demand for tamper-indicating systems which ensure that a container is not re-filled with non-original contents. Whilst it is relatively easy to produce some form of tamper-evidence, it is much more difficult to provide tamper-evidence which cannot be either overcome without causing the tamper-evidence system to activate, or activated and then returned to a visually identical state so as to appear non-activated.

A particularly useful method of providing tamper-evidence is to use a system in which a closure is initially located in a first position, but once removed can only be returned to a second position which is visually distinct from the first position. For example, U.S. Pat. No. 5,738,231 describes a closure with a part which is moved during the opening process so that following opening it cannot pass back over a projection on the container finish. The result is that the closure can only return to a position in which it is axially displaced with respect to its original position. Document WO 02/096771 describes a closure with a first portion with inner and outer parts, and a second portion. Initially a section of the inner part of the first portion protrudes below the level of the outer part and is held firmly by a region of the second portion which is formed so as to have a reduced circumference. When the first portion is removed the section of the inner part is pulled from under the area of reduced circumference on the second portion. After removal the inner part of the first portion and the area of reduced circumference on the second portion retain their original dimensions, so that if the first portion is reapplied the inner part can no longer pass under the area of reduced circumference. Accordingly a gap is produced between the outer part of the first portion and the second portion, because the section of the inner part which was previously trapped under the second portion is now trapped above the area of reduced circumference.

In both of the above prior art documents a gap is formed by trapping an obstructing member. The problem with such systems is that the obstruction member is easily accessible and could be removed, for example by cutting to defeat the tamper-evidence.

The present invention seeks to address the above problem.

SUMMARY OF THE DISCLOSURE

The present invention provides a tamper-evident closure for a container, the closure comprising a first portion including inner and outer parts and a second portion, the outer part is movable relative to the inner part from a first position in which the outer part is immediately adjacent the second portion to a second position in which there is an unobstructed gap therebetween, the inner and outer parts are adapted to become irreversibly locked in the second position so that the outer part cannot be moved back to the first position to close the gap.

The present invention therefore does not rely on an obstructing member becoming trapped to form a gap therebetween. By forming an unobstructed gap it is not possible to defeat the tamper-evidence by a simple cutting operation.

The second portion may be connected to a container and the first portion may comprise a cap. Certain industries demand closures with a first portion comprising, a cap and a second portion comprising a sleeve which is connected to a container; for example the spirits industry.

The second portion may be permanently fixed in its position on the container. This prevents the second portion from being moved upwardly to close the gap.

The first portion may be adapted to engage an in-bore fitment associated with the container. Certain industries, in particular the spirits industry, demand additional measures to prevent tampering. In-bore fitments such as non-return fitments are often fitted to containers to prevent re-filling regardless of other tamper-evidence measures.

The first portion may include a ratchet arrangement for locking the inner and outer parts in the second position. A ratchet arrangement is a simple and efficient method of irreversibly locking the inner and outer parts together.

The first portion may include formations, such as screw threads, for engaging the container or in-bore fitment as appropriate. In such cases the ratchet arrangement or other locking mechanism may be located above the formations so as to increase the difficulty in accessing and tampering with the locking arrangement.

The gap formed in the closure may be at the respective adjacent peripheries of the portions. By forming the gap at the peripheries the gap is more visually obvious.

The inner part may include a part which extends beyond the outer part towards the second portion in the second position. Whilst the part is in no way an obstruction member and is in no way required for formation of the unobstructed gap, the part is visible through the gap. The part could be, for example, a brightly coloured band to accentuate the presence of the gap.

The present invention also provides, in combination a container and a tamper-evident closure, the closure comprising a first portion including inner and outer parts, and a second portion, the second portion is connected to the container and the first portion is the removable top cap, the first portion outer part is movable relative to the inner part from a first position in which the outer part is immediately adjacent to the second portion to a second position in which there is an empty, unobstructed gap therebetween. Thereafter the first portion is removable and the inner and outer parts are adapted to become irreversibly locked in the second position so that the outer part cannot be moved back to the first position to close the gap when the first portion is replaced.

The combination may further comprise an in-bore fitment connectable to the container, the first portion being adapted to engage the fitment.

The present invention will now be more particularly described, by way of example, with reference to the following drawings, in which:

DETAILED DESCRIPTION

Figure 1:
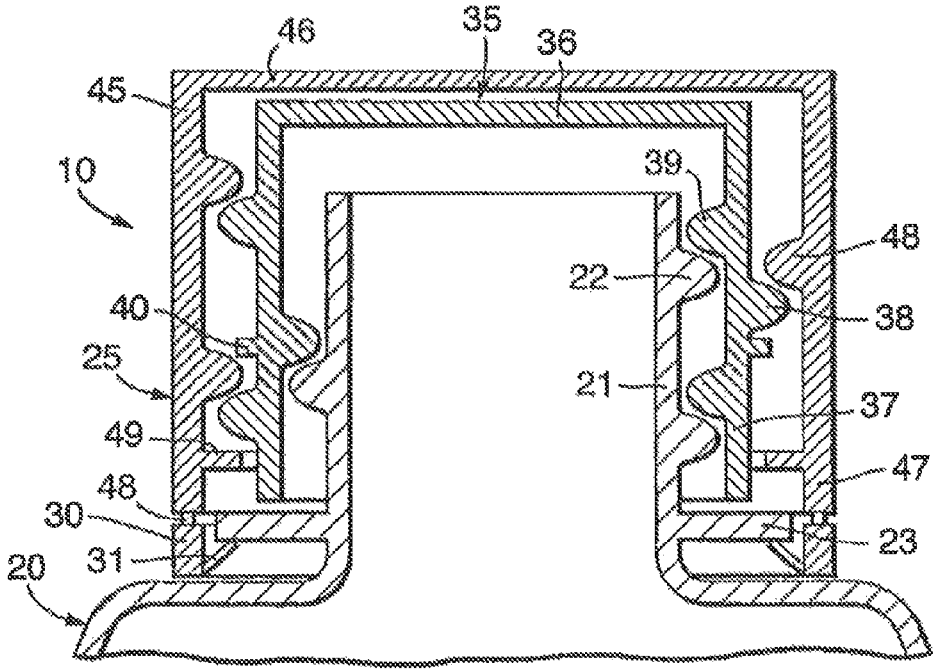
FIG. 1 is a section of a closure according to a first embodiment of the present invention, shown attached to a container and being in a first position.

Referring to FIG. 1 there is shown a tamper-evident closure generally indicated 10 attached to a container generally indicated 20. The container 20 includes a neck portion 21 with external screw threads 22. At the lower end of the neck 21 is an annular retention ring 23, the purpose of which is described in more detail below.

The closure comprises a first portion 25 and a second portion 30. The first portion 25 includes inner 35 and outer 45 parts.

The inner part 35 comprises a disk-shape top plate 36 with a cylindrical skirt 37 depending from its periphery.

The outer surface of the skirt 37 has screw threads 38 for engaging corresponding threads on the outer part 45.

The inner surface of the skirt 37 has screw threads 39 for engaging corresponding threads 22 on the container 20.

Figure 3:
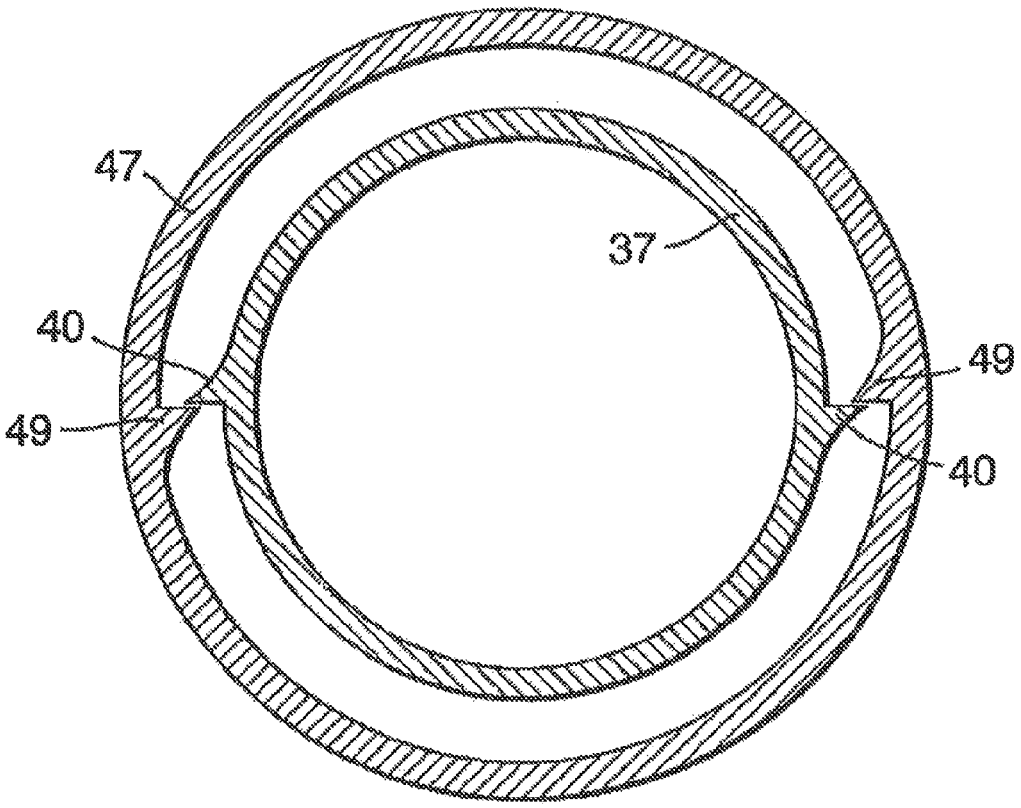
FIG. 3 shows a diagrammatic section along line III-III of FIG. 2 illustrating a ratchet arrangement for locking the closure in the second position.

Approximately half way along its length, the outer surface of the skirt 37 also includes two diametrically opposed wedge-shape ratchet members 40 (best shown in FIG. 3).

The outer part 45 comprises a disk-shape top plate 46 with a cylindrical skirt 47 depending from its periphery.

The inner surface of the skirt 47 has screw threads 48 for engaging the threads 38 on the inner part 35.

At its open end, the inner surface of the skirt also includes two dimensionally opposed, wedge-shape ratchet members 49 (best shown in FIG. 3).

The second portion 30 comprises an annular tamper-evident band and is connected to the open end of the outer part skirt 47 by frangible bridges 48. At the other end of the second portion 30, a plurality of flaps 31 project radially inwardly and upwardly. The flaps 31 are positioned to engage beneath the annular retention ring 23 on the container 20.

The operation of the closure will now be described with reference to FIGS. 2 to 5.

In order to open the closure 10 the outer part 45 is grasped and turned. The tightness of fit between the inner part 35 and the neck portion 21 is designed to be greater than that between the inner part 35 and the outer part 45, which means that there is greater friction. Accordingly when the outer part 45 is initially turned it is the outer part 45 which moves axially upwards relative to the inner part 35; the inner part remains stationary.

As the outer part 45 moves upwards the flaps 31 prevent the second portion 30 from moving by virtue of their engagement under the retention ring 23. As a result the frangible bridges 48 break and the second portion 30 remains in position.

Figure 2:
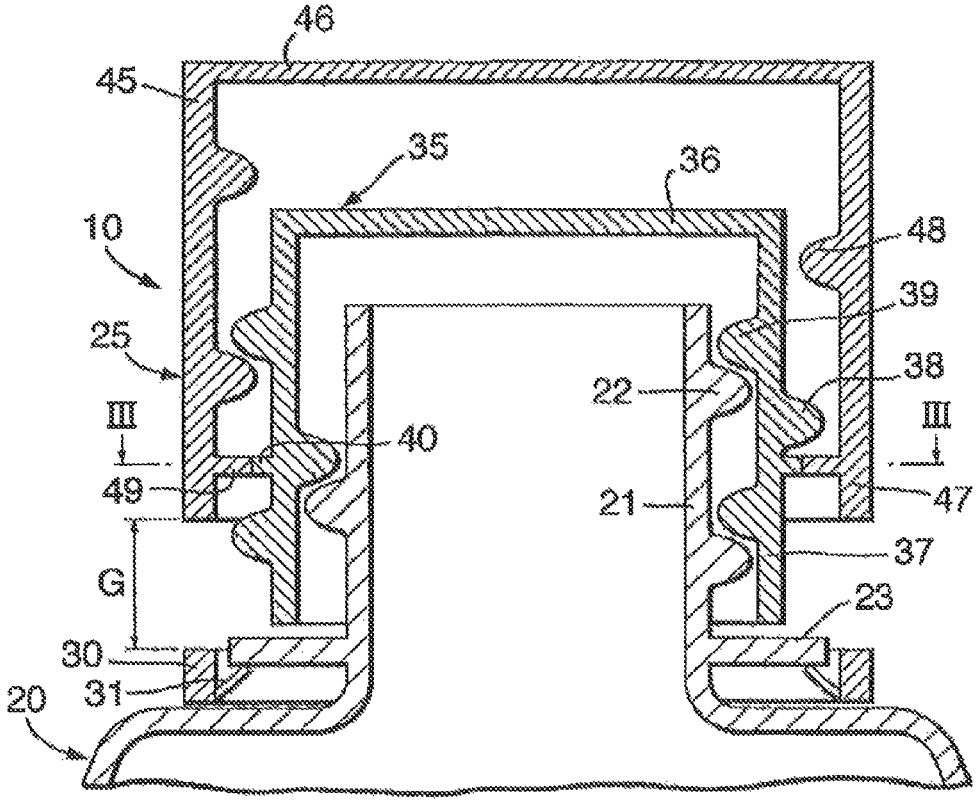
FIG. 2 shows the closure of FIG. 1 in a second position prior to removal from the container.

Continued turning of the outer part 45 eventually leads to the ratchet members 40, 49 passing each other and locking in the position shown in FIGS. 2 and 3. The outer and inner parts 45, 35 are now irreversibly locked in this second position. It will be seen that there now exists a gap (G) between the open end of the outer part skirt 47 and the second portion 30. The gap (G) is empty and unobstructed; that is, the gap (G) is not created by an obstruction structure which braces between the skirt 47 and the second portion 30.

Figure 4:
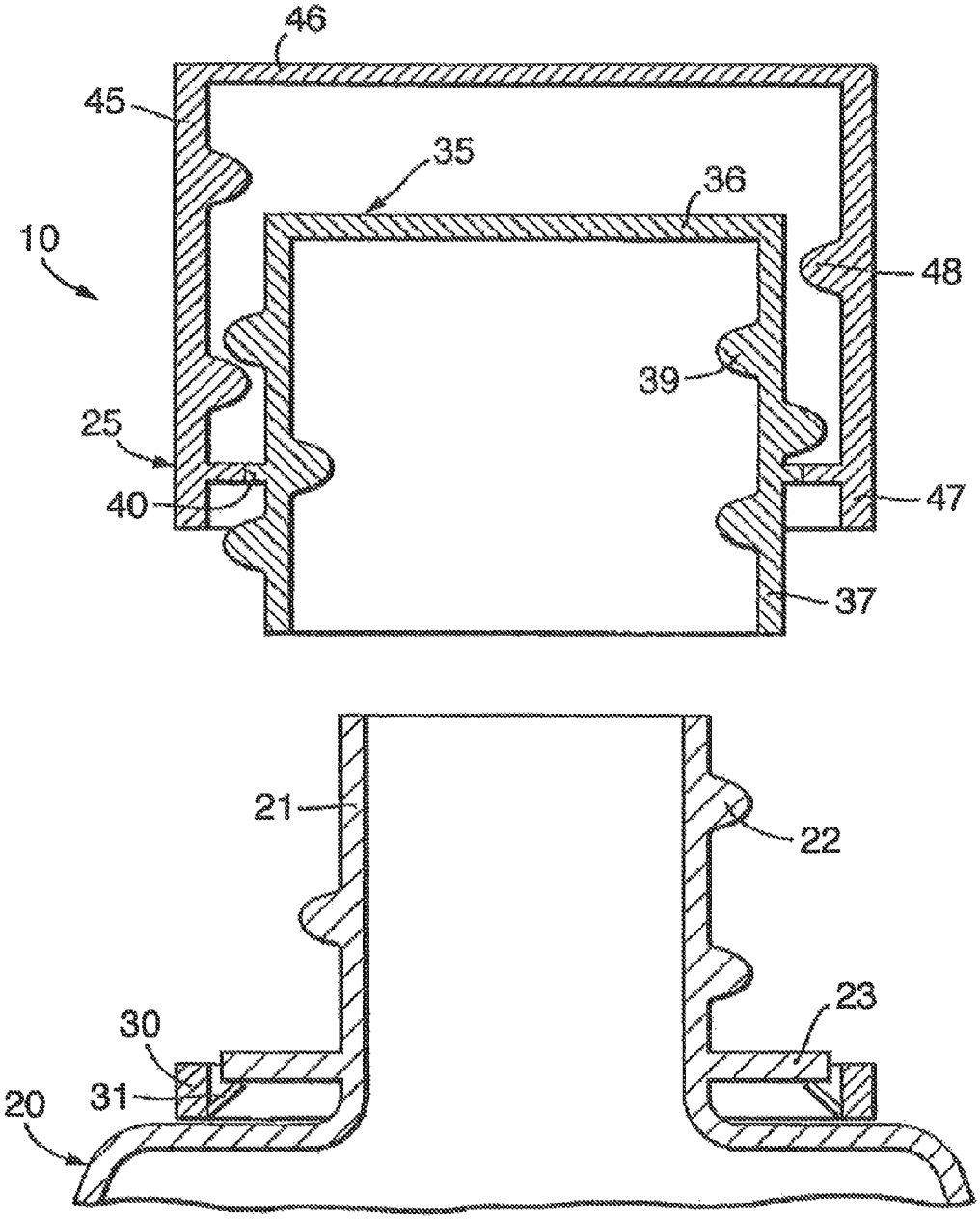
FIG. 4 shows the closure of FIG. 3 following removal from the container.
Figure 5:
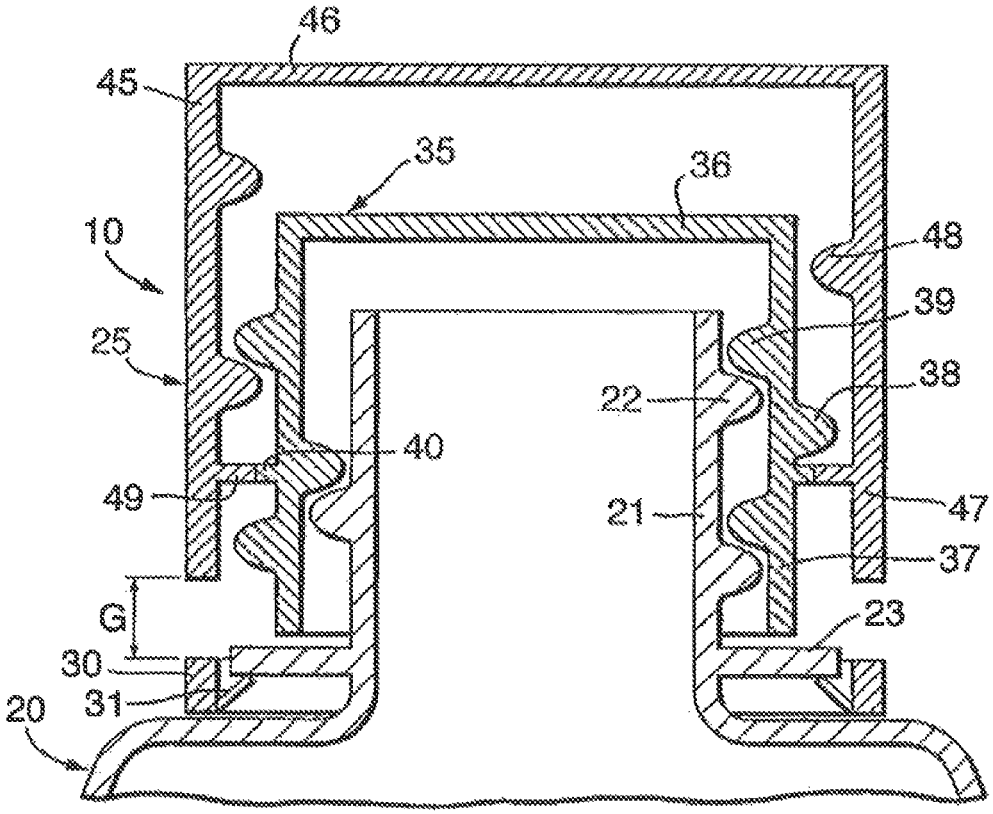
FIG. 5 shows the closure of FIG. 4 following re-attachment to the container following first opening.

With the outer 45 and inner 35 parts locked together as shown in FIG. 2, continued turning of the outer part 45 now acts to unscrew the inner part 35 from the container neck 21. In FIG. 4 the closure 10 is shown removed completely from the container neck 21 to allow access to the container 20.

When the closure 10 is replaced on the container neck 21 it cannot be returned to its first position because the inner and outer parts 35, 45 are still locked together. Instead the closure can only be returned to the position shown in FIG. 5, in which the gap (G) remains.

In this embodiment it will be noted that the length of the inner part skirt 37 is such that it protrudes below the level of the outer part skirt 47 in the second position. As a result, the skirt 37 can be seen through the gap (G). The skirt 37 could, for example, be brightly coloured or include a message in the area visible through the gap (G) to accentuate the fact that the gap (G) is there and warn of potential tampering.

FIGS. 6 to 13 show an alternative embodiment of the present invention. In this embodiment the closure 110 forms part of a tamper-evident arrangement for a container 120 having a neck 121 with an associated in-bore non-return fitment generally indicated 100.

Figure 6:
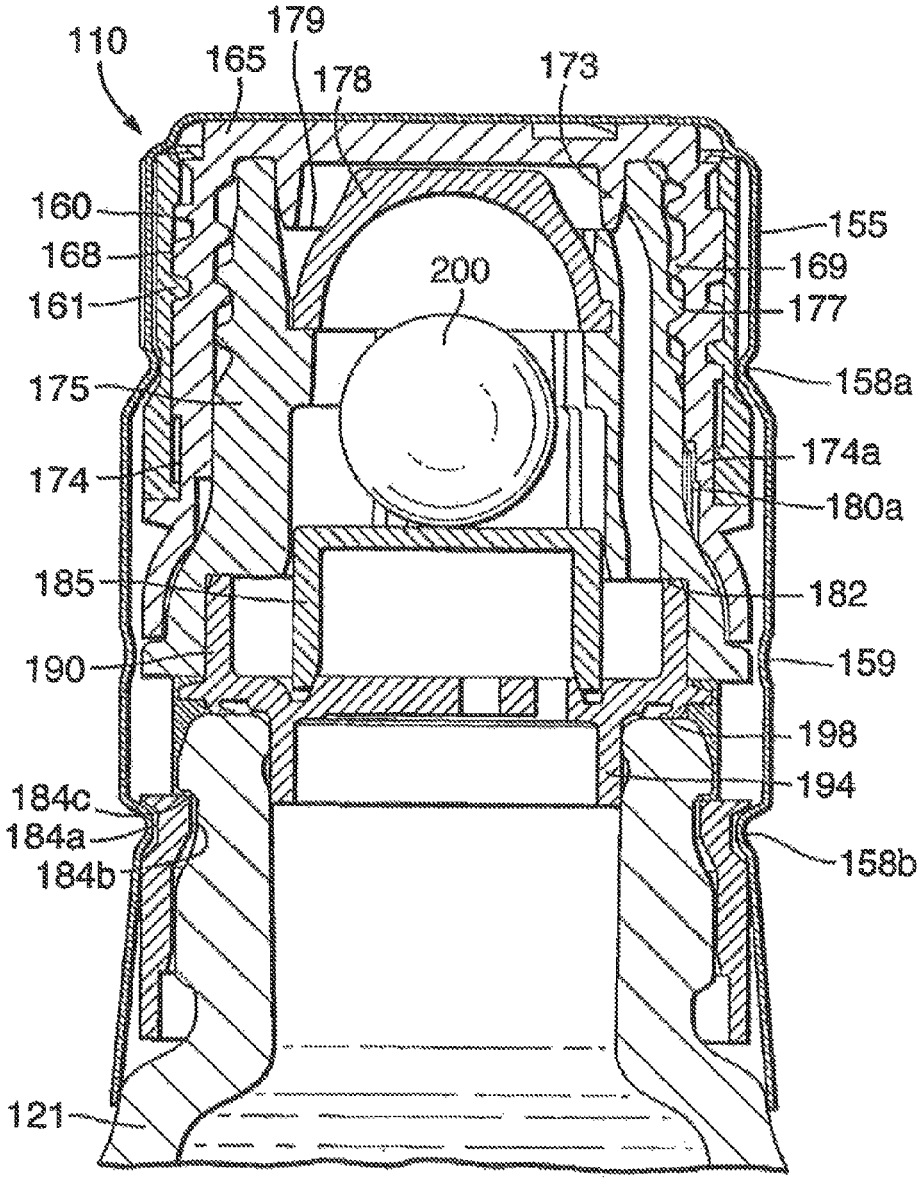
FIG. 6 is a section of a tamper-evident closure according to an alternative embodiment, shown forming part of a tamper-evident arrangement on a container neck and being in a first position.

Referring generally to FIG. 6, the components of the tamper-evident arrangement are as follows: the closure 110 comprises a shell 155, a ratchet part 160 and a liner part 165; the non-return fitment 100 comprises a pouring part 175, a ball 200, a float valve 186 and a basket part 190.

The components of the tamper-evident-arrangement will now be described in more detail.

Figure 7:
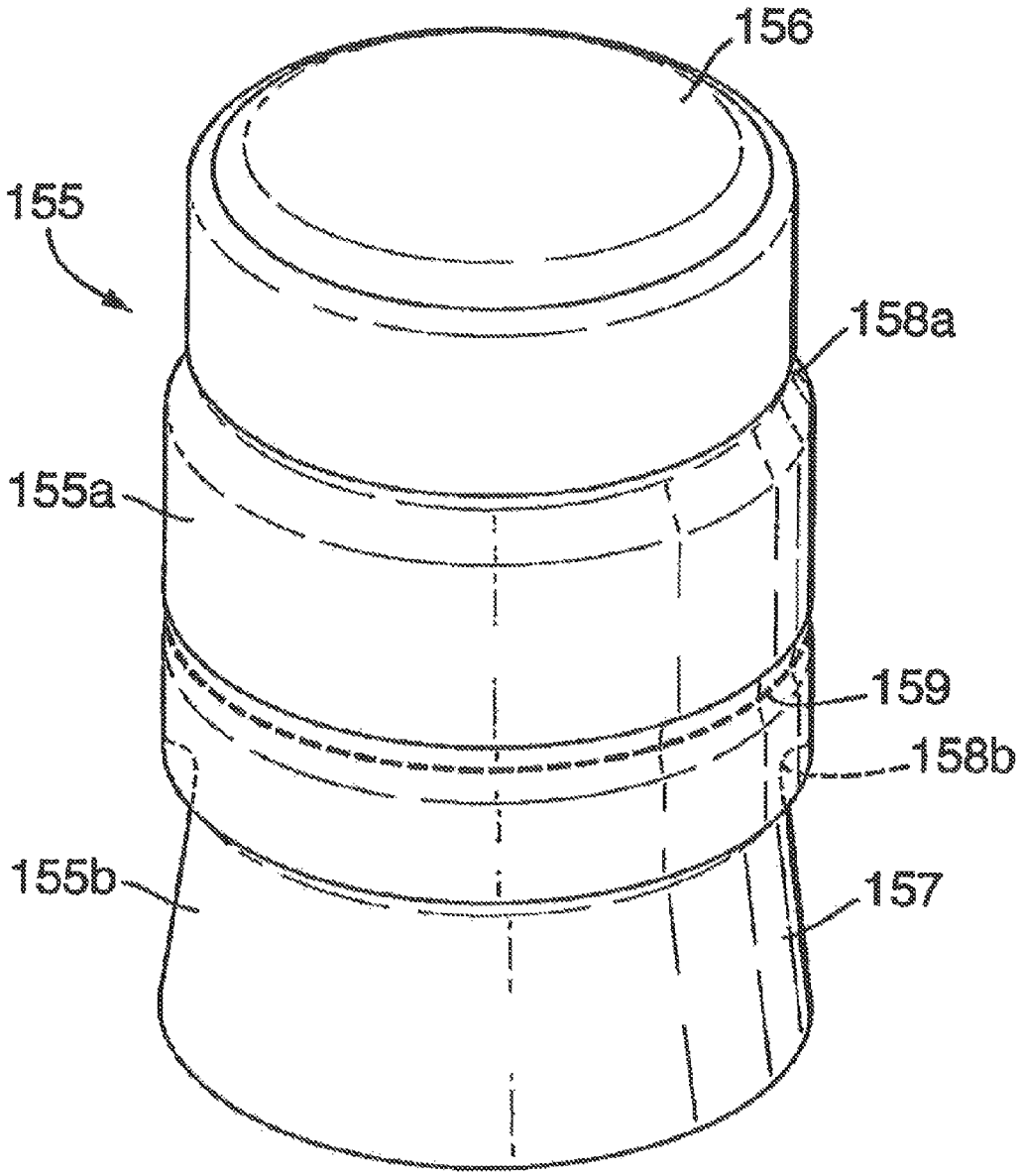
FIG. 7 is a perspective view of a shell forming part of the closure of FIG. 6.

The closure shell 155 is shown in FIG. 7 and is a metal closure of the well-known "roll-on pilfer-proof" type. The shell comprises a disk-shape top plate 156 with a side wall 157 depending from its periphery. The shell 155 includes upper **155*a* and lower 155*b* sections. The shape of the side wall 157 is determined at least in part after the shell is applied because a series of rollers and cutters are used to form a frangible line 159 and first 158*a* and second 158*b*** rolled-in regions, as is described in more detail below.

Figure 8:
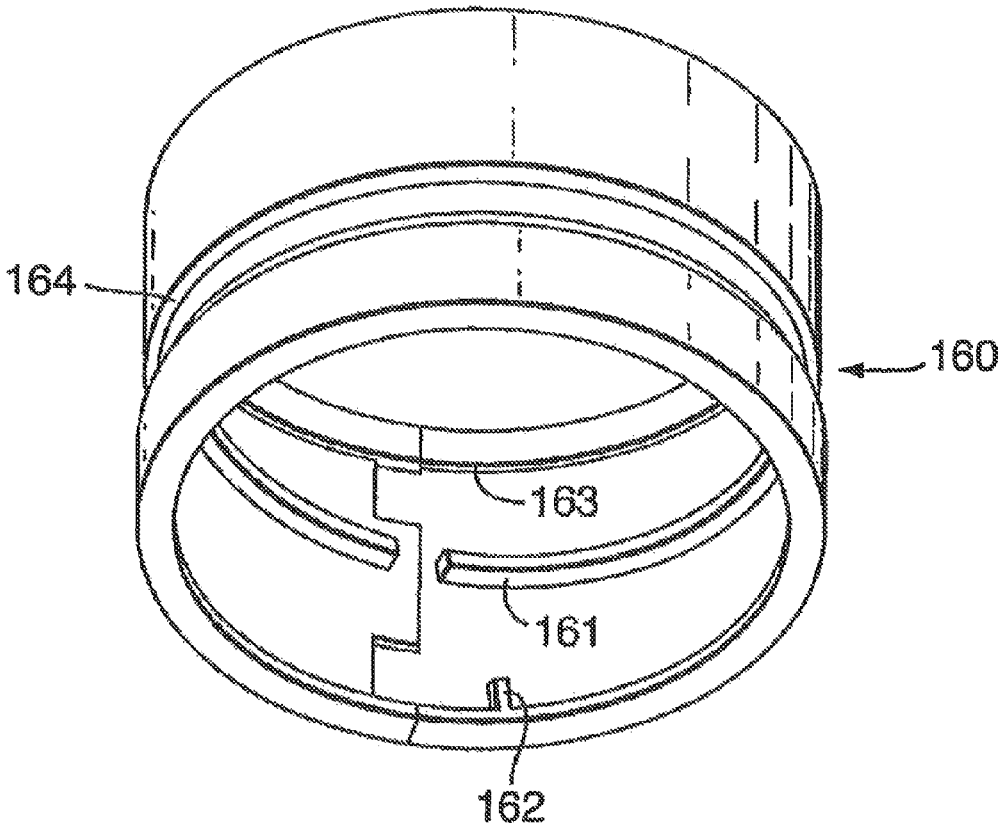
FIG. 8 is a perspective view of a ratchet member forming part of the closure of FIG. 6.

The ratchet part 160 is shown in FIG. 8 and comprises a tubular body part. The inner surface of the part 160 includes screw threads 161. The inner surface also includes a ratchet member 162 for engaging a corresponding notch in the liner part 165. The inner surface also includes a ratchet step 163 formed by a band of thicker material at the opposite end of the part 160 to the ratchet member 162. The outer surface includes an annular groove 164 which is used to hold the part 160 in the shell 155 by virtue of a first crimped-in region 158 of the shell 155 (see FIG. 6).

Figure 9:
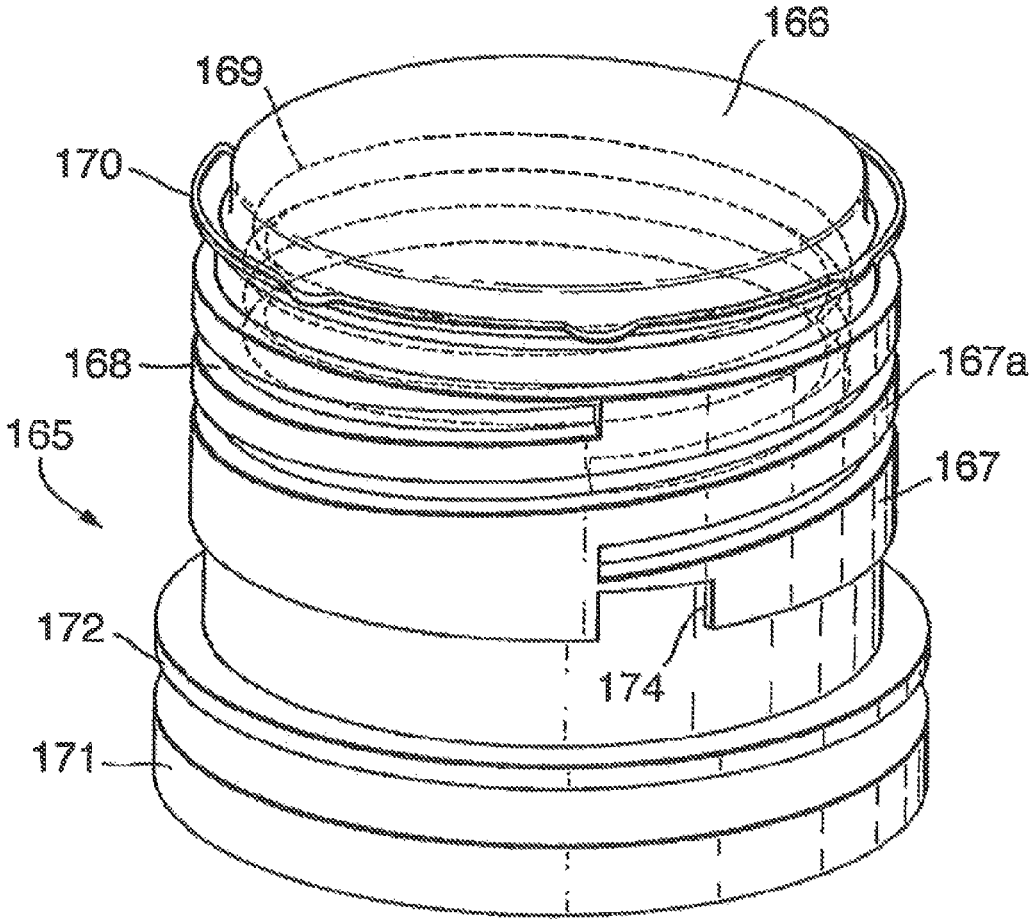
FIG. 9 is a perspective view of a liner part forming part of the closure of FIG. 6.

The liner part 165 is shown in FIG. 9 and comprises a disk-shape top plate 166 with a cylindrical skirt 167 depending from its periphery. The upper part 167*a* of the surface of the skirt 167 includes screw threads 168 for engaging the threads 161 of the ratchet part. The inner surface of the skirt 167 includes screw threads 169 (shown in phantom on FIG. 9) for engaging corresponding threads on the pouring part 175. Below the thread start of the external screw thread 168 is a notch 174 for receiving the ratchet member 162 of the ratchet part 160. Below the thread start of the internal screw thread 169 is a ratchet tooth 174*a* (see 6) for engaging a corresponding tooth 180*a* on the outer surface of the pouring part 175 (see FIG. 6).

The top plate 166 is surrounded by an annular upturned flap 170. The skirt 167 includes an annular extension portion 171 below an annular flange 172 at the lower end of the skirt 167.

As shown best in FIG. 6, an annular plug band 173 depends from the inner surface of the top plate 166 and is adapted to engage in the pouring part 175.

Figure 10:
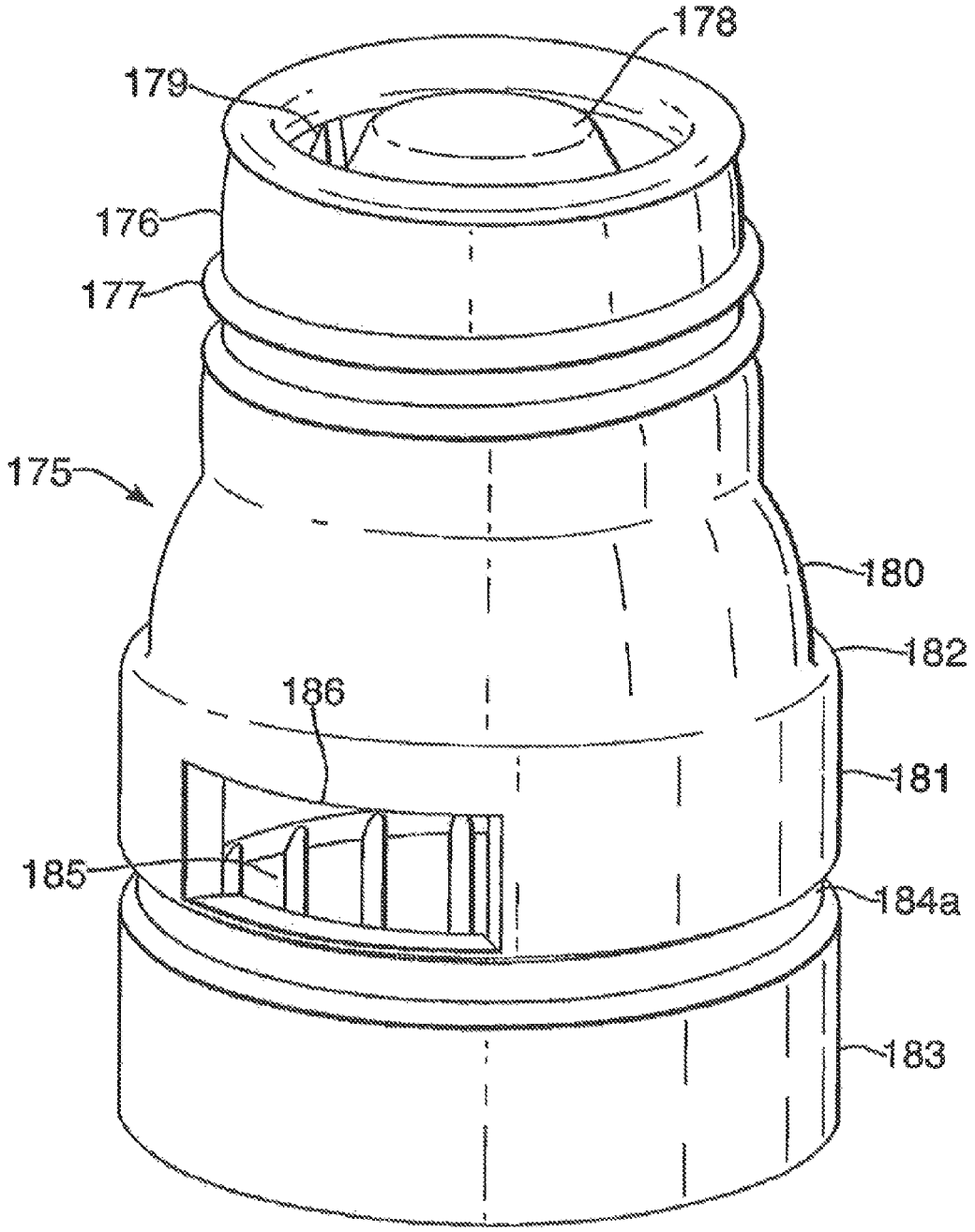
FIG. 10 is a perspective view of a pouring part forming part of the non-return fitment of FIG. 6.

The pouring part 175 is shown in FIG. 10 and comprises a generally frusto-conical hollow body with an upper thread-bearing portion 176 having external screw threads 177 for engaging the internal screw threads 169 on the liner 165. Within the thread bearing portion 176 is positioned a dome-shape flow regulator 178. The regulator 178 is attached by three axial spokes 179 to the inner wall of the portion 176 to provide a flow path around the regulator 178.

A ball chamber 180 depends from the portion 176 and is sized to accommodate the ball 200 in such a way that it can move freely. The outer surface of the ball chamber 180 includes the ratchet tooth 180*a* for engaging the ratchet tooth 174*a* of the liner part 165, A basket-retaining part 181 depends from the ball chamber 180. The internal bore of the basket-retaining part 181 is increased by a step 182 at the bottom of the hall chamber 180. The increased bore is sized to accommodate the basket 190 as described below.

A neck-engaging part 183 depends from the basket retaining part 181. The neck-engaging part 183 begins with an external annular groove 184*a* which is used to help hold the fitment 175 on the container neck 121 by virtue of the second rolled-in region 158*b* of the shell (see FIG. 6).

Below the groove 184*a*, the internal surface of the part 183 includes a plurality of axial ribs 185 for engaging ribs 125 on the container neck 121, as described below. The ribs 185 are visible in FIG. 10 through a window 186 in the basket-retaining part. An identical window is present diametrically opposite (not shown). The windows 186 are present so that a sharp retention edge 184*c* can be formed in a molding production process. The edge 184*c* provides a very strong connection under the lip 123 of the container neck 121.

Opposite the external groove 184*a* is an internal step 184*b*.

Figure 11:
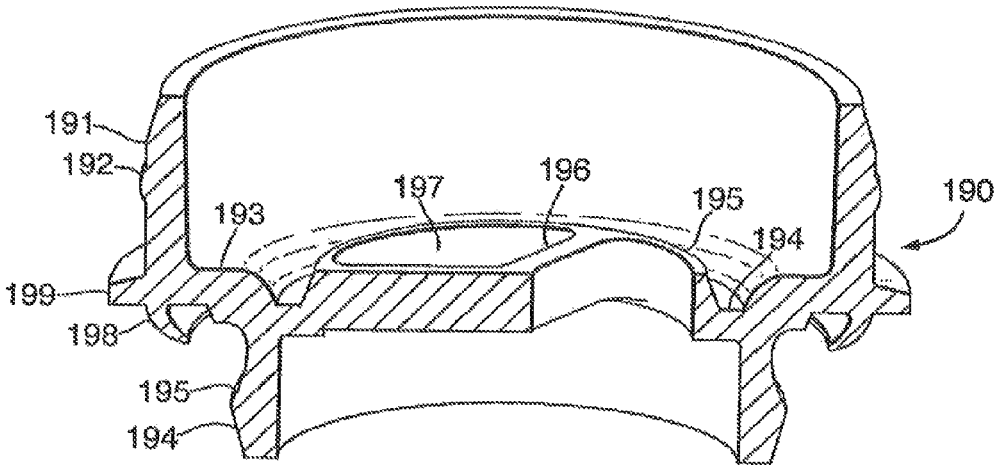
FIG. 11 is a perspective section of a basket part forming part of the non-return fitment of FIG. 6.

The basket part 190 is shown in FIG. 11 and includes an annular upper part 191 sized so that it has an interference sealing fit within the basket-retaining part 181 of the pouring part 175. The seal is improved with the presence of a bead 192 approximately half way along the outer surface of the part 191. The internal diameter of the part 190 decreases at the lower end of the upper part 191 with a curved step 193 and continues to form an annular plug part 194 sized to fit sealingly into the internal bore of the container neck 121. Approximately half way along the external surface of the plug part 194 is a bead 195 for improving the seal against the container neck 121.

At the intersection of the step 193 and the plug part 192 a valve seat comprising a circular groove 194 extends radially inwardly and connects to a non-return valve comprising an upstanding hoop 195 with the three internal spokes 196 forming three generally triangular orifices 197. At the bottom of the annular upper part 191 an inwardly curved sealing member 198 depends. The sealing member 198 can flex upwardly towards the underside of the step 193 and is positioned to seal against the upper surface 122 of the container neck.

Also at the bottom of the annular upper part 191 a circumferential flange 199 extends radially outwards.

Figure 12:
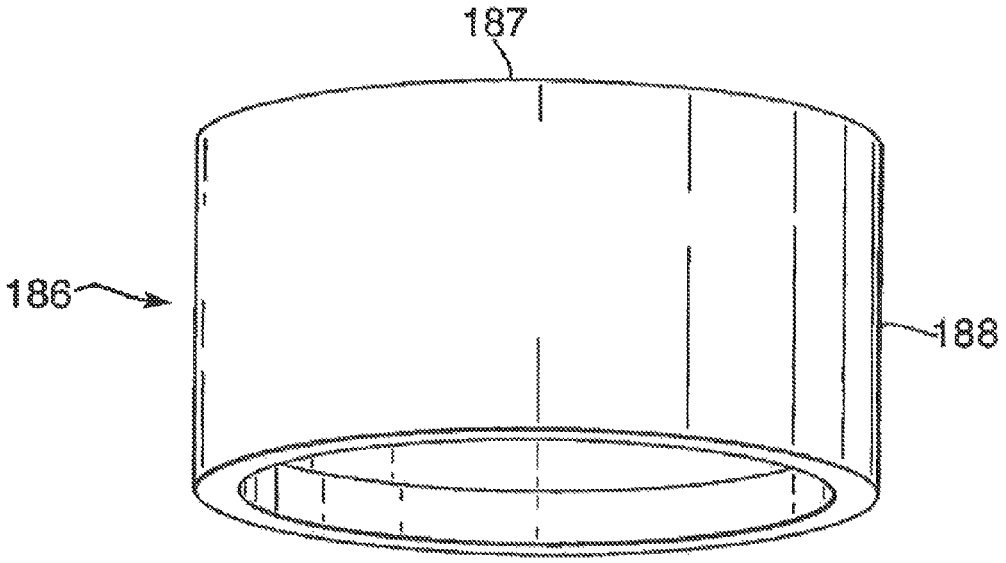
FIG. 12 is a perspective view of a float forming part of the non-return fitment of FIG. 6.

The float valve 186 is shown in FIG. 12 and comprises a disk-shape top plate 187 with a cylindrical skirt 188 depending from its periphery. The skirt 188 is sized so that its open end fits into the groove 194 of the basket part 190.

Figure 13:
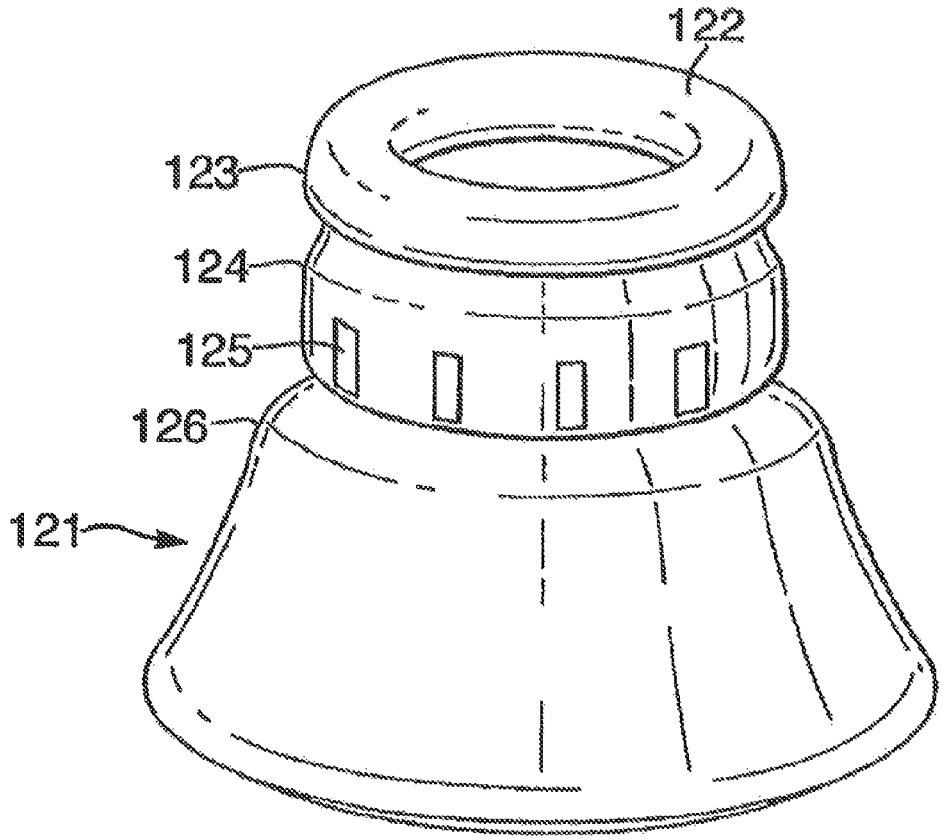
FIG. 13 is a perspective view of the neck finish of FIG. 6.

The neck finish 121 is shown in FIG. 13 and comprises an upper lip 123 below which is a lower portion 124 of reduced diameter. The lower portion has a plurality of spaced axial ribs 125 around its periphery. A shoulder emerges from the lower end of the lower portion 124.

The tamper-evident arrangement shown in FIG. 6 is assembled as follows.

The ball 200 is placed in the ball chamber 182. The float 186 is placed on the basket 190 and sits in the groove 194. The upper part 191 of the basket is pushed into the basket-retaining part 181 of the pouring part 175; the insertion extent is limited by the step 182. The liner part 165 is screwed onto the pouring part 175 using the corresponding screw threads 169, 177. The plug part 173 enters the inner bore of the thread bearing portion 176. The ratchet part 160 is connected to the pouring part by opening the tubular body part at the split line 160*a*. The part 160 is then fitted around the upper part 167*a* of the pouring part before allowing the part 160 to close with the threads 161, 168 now engaged and the lower edge of the ratchet resting on the liner flange 172.

The ratchet part 160, liner part 165, pouring part 175, ball 200, float valve 186 and basket part 190 are then added to the container neck 121 by pressing the neck-engaging part 183 of the pouring part 175 over the lip 123. The plug part 192 of the basket 190 enters the inner bore of the container neck 121 until the sealing member 198 contacts the upper surface 122 of the container neck 121 and the step 184*b* clips under the lip 123. At this point the ribs 125, 185 on the neck 121 and pouring part 175 engage to prevent relative rotation.

The shell 155 is now added. The shell side wall 157*b* is initially straight. Following placement over the rest of the tamper-evident arrangement the side wall is crimped into the groove 164 of the ratchet part and the groove 184 of the pouring part at points 158*a* and 158*b* respectively.

A frangible line 159 is created approximately half way down the side wall 157 by slitting to leave thin bridges (not shown).

The operation of the closure is as follows.

Initially the upper section 155*a* of the shell 155 is grasped above the frangible line 159 and twisted. The pouring part 175 cannot turn by virtue of the ribs 125, 185 on the container neck 121 and the neck-engaging part 183. The lower section 155*b* of the section of shell below the frangible line is firmly connected to the pouring part by crimped-in region 158*b*, and also cannot turn. The liner part 165 is prevented from turning relative to the pouring part 175 at this stage because of the interaction of the ratchet teeth 174*a*, 180*a*.

The upper section 155*a* of the shell turns and the frangible line 159 breaks. The turning of the upper section 155*a* turns the ratchet part 160 by virtue of the firm connection provided by the region 158*a* in the groove 164.

The ratchet part 160 continues to rise in the upper shell section 155*a* until the step 163 passes over the flap 170 and the ratchet member 162 enters the notch 174 on the liner part 165. The flap 170 prevents the upper-shell section 155*a* from moving back down by its engagement with the step 163 and the ratchet member 162 prevents relative rotation between the ratchet part 160 and the liner part 165. Because the step 163 and flap 170 are located above the respective screw threads, access to this part of the closure is made difficult. Re-setting of the ratchet arrangement is thereby made more difficult.

Figure 14:
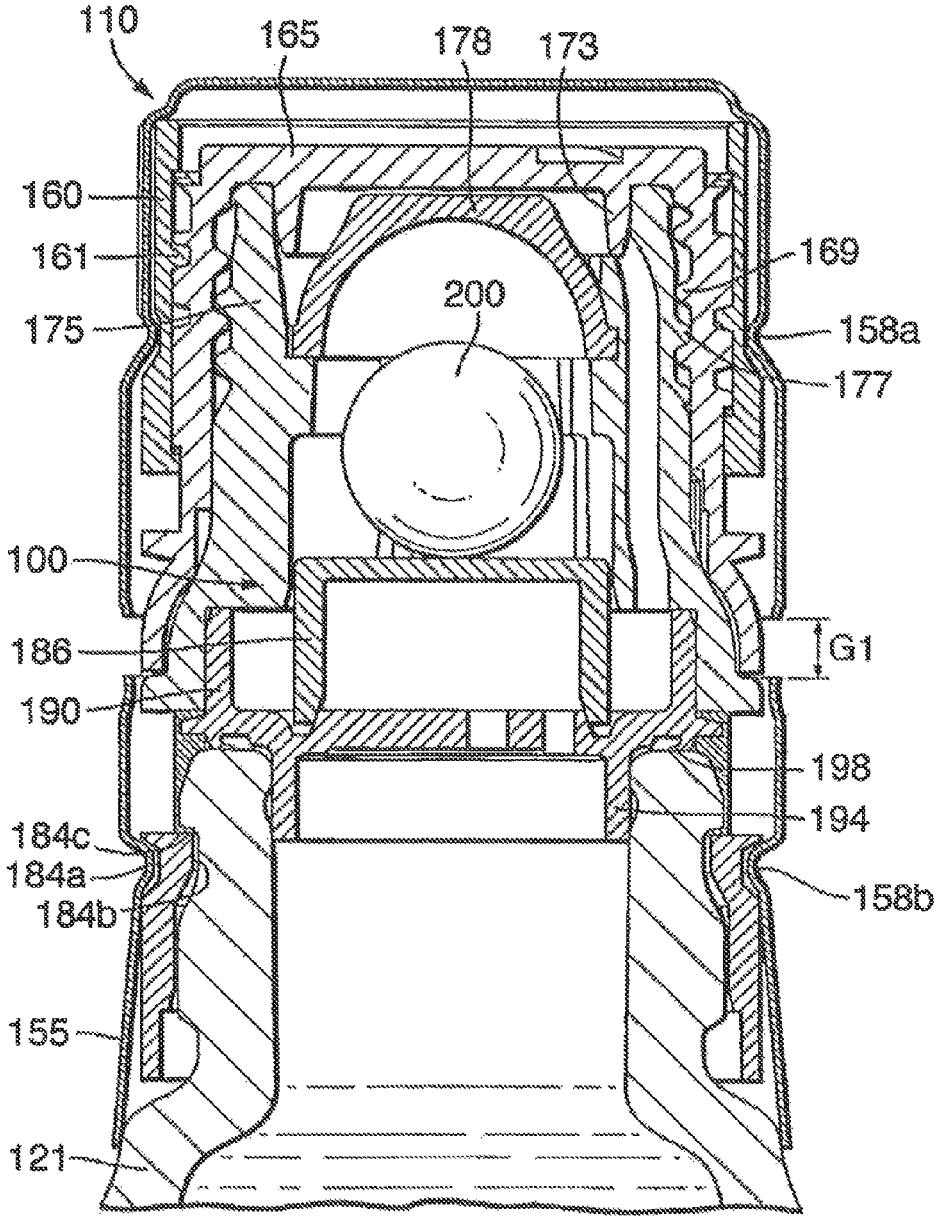
FIG. 14 is section of the closure of FIG. 6 with the closure shown in a second position.

The tamper-evident arrangement is now shown in the position shown in FIG. 14. A gap (G1) is formed in the shell 155 between the upper 155*a* and lower 155*b* shell sections. The gap (G1) is unobstructed; there is no obstacle at the point of dislocation to prevent closing of the gap (G1). Continued turning of the upper shell section 155*a* now turns the liner 165 with respect to the pouring part 175; again the pouring part 175 remains stationary.

The action of twisting the liner part 165 off the pouring part 175 may break one or both of the ratchet teeth 174*a*, 180*a*, and may make a 'crack' sound to reinforce the tamper-proof nature of the closure. Therefore the interaction of the ratchet teeth 174*a*, 180*a* must be strong enough to counter the force of the ratchet part 160 turning relative to the liner part 165. In particular the interaction must be strong enough to remain intact as the ratchet part step 163 passes over the liner flap 170. However, the ratchet teeth 174*a*, 180*a* interaction is such that it can be overcome once the ratchet part 160 and liner part 165 are locked in place. Other types of semi-permanent locking arrangements could be used between the liner part 165 and the pouring part 175. For example the parts could be glued together. Preferably the locking arrangement is destroyed during the opening operation to prevent the tamper-evident arrangement from being re-set.

The non-return fitment 100, of which the pouring part 175 forms part, will be well known to those skilled in the art and its operation will not be described in detail.

The upper shell section 155*a*, the ratchet part 160 and the liner part 165 are then removed to expose the pouring part 175.

When the upper shell section 155*a* is replaced and the liner part 165 is screwed back onto the pouring part 175, the gap (G1) cannot be re-closed because the ratchet part 160 prevents the upper shell section 155*a* moving down further than is shown in FIG. 14. It will be noted that the annular extension portion 171 of the liner 165 is visible through gap (G1) in the position shown in FIG. 14.

The upper shell section 155*a* constitutes the first portion outer part of the closure. The liner 165 constitutes the first portion inner part. The lower shell section 155*b* constitutes the second portion. The ratchet part 160 locks the inner and outer parts together.

What is claimed:

1. A tamper-evident closure for a container, said closure comprising:

a. a first portion, said first portion comprising an inner part and an outer part; and b. a second portion, said outer part movable relative to said inner part from a first position in which said outer part is immediately adjacent said second portion to a second position in which said outer part is not immediately adjacent to said second portion so as to form an unobstructed gap between said outer part and said second portion when said outer part is in said second position, wherein said unobstructed gap extends around the entire periphery of said closure, said inner part and said outer part being constructed and arranged to become irreversibly locked in said second position so that said outer part cannot be moved back to said first position to close said unobstructed gap.

2. A closure according to claim 1, wherein said second portion is adapted to be connected to said container and said first portion comprises a cap.

3. A closure according to claim 2, wherein said second portion is permanently fixed in its position on said container.

4. A closure according to claim 1, wherein said first portion is adapted to engage an in-bore fitment associated with said container.

5. A closure according to claim 1, wherein said first portion further comprises a ratchet arrangement for locking said inner part and said outer part in said second position.

6. A closure according to claim 5, wherein said first portion further comprises engagement formations and said ratchet arrangement is located above said engagement formations.

7. A closure according to claim 1, wherein said gap is formed at the respective adjacent peripheries of the said first portion and said second portion.

8. A closure according to claim 1, wherein said inner part includes an extension which extends beyond said outer part towards said second portion in said second position, wherein at least a portion of said extension being positioned so as to be visible through said gap.

9. In combination, a container and a tamper-evident closure, said tamper evident closure comprising:

a. a first portion, said first portion comprising an inner and outer part; and b. a second portion, said second portion being connected to said container and said first portion being a removable top cap, said outer part being movable relative to said inner part from a first position in which said outer part is immediately adjacent said second portion to a second position in which said outer part is not immediately adjacent to said second portion so as to form an empty, unobstructed gap between said outer part and said second portion when said outer part is in said second position, wherein said unobstructed gap extends around the entire periphery of said closure, wherein in said second position said first portion is removable and said inner and said outer part are constructed and arranged to be irreversibly locked in said second position so that said outer part cannot be moved back to said first position to close said gap when said first portion is replaced.

10. A combination according to claim 9, further comprising an in-bore fitment connectable to said container, said first portion being constructed and arranged to engage said fitment.

11. The tamper evident closure of claim 1, wherein said inner part further comprises a disk-shaped top plate with a cylindrical skirt depending from the periphery of said top plate and wherein said cylindrical skirt has a first set of screw threads for engaging a first set of corresponding threads on said outer part; and, the inner surface of said cylindrical skirt has a second set of screw threads for engaging a second set of corresponding threads on said container.

12. The tamper evident closure of claim 1, wherein said first portion further comprises:

a. an inner part skirt; and b. an outer part skirt.

13. The tamper evident closure of claim 12, wherein said second portion further comprises:

a. an annular tamper-evident band connected to an open end of said outer part skirt by a set of frangible bridges; and b. a plurality of flaps projecting radially and upwardly, and wherein said plurality of flaps is positioned to engage beneath an annular retention ring on said container.

14. The tamper evident closure of claim 12, wherein the length of said inner part skirt is such that it protrudes below the level of said outer part skirt in said second position and wherein at least a portion of said inner part skirt is visible through said gap.

15. The tamper evident closure of claim 14, wherein said protruding portion of said inner part skirt comprises a visual marking visible through said gap and indicative of said gap.

16. The tamper evident closure of claim 15, wherein said visual marking is selected from the group consisting of: (a) a colored band; (b) a text display; and (c) a graphic image.

17. A system for providing an indication of the opening of a closure, said closure mounted on a container, said system comprising:

a. a first portion of said closure, wherein said first portion is a removable top, said first portion further comprising:
   i. an inner part;
   ii. an outer part; and
   iii. a ratchet arrangement for locking said inner part and said outer part; and b. a second portion of said closure, said second portion connected to said container, wherein said outer part is movable relative to said inner part from a first position in which said outer part is immediately adjacent said second portion, to a second position in which said outer part is not immediately adjacent to said second portion, so as to form an empty, unobstructed gap between said outer part and said second portion when said outer part is in said second position, wherein said unobstructed gap extends around the entire periphery of said closure, wherein in said second position said first portion is removable and said inner part and said outer part are constructed and arranged to be irreversibly locked in said second position, so that said outer part cannot be moved back to said first position to close said gap when said first portion is replaced.

18. The system according to claim 17, said system further comprising an in-bore fitment connectable to said container, said first portion being constructed and arranged to engage said fitment.

19. The system of claim 17, wherein said first portion further comprises:

a. an inner part skirt; and b. an outer part skirt.

20. The system of claim 19, wherein said second portion further comprises:

a. an annular tamper-evident band connected to the open end of said outer part skirt by a set of frangible bridges; and b. a plurality of flaps projecting radially and upwardly, and wherein said plurality of flaps is positioned to engage beneath an annular retention ring on said container.

* * * * *